US009358412B2

(12) United States Patent
Nelson et al.

(10) Patent No.: US 9,358,412 B2
(45) Date of Patent: Jun. 7, 2016

(54) IN-GROUND TRAMPOLINE PAD SYSTEM

(71) Applicants: R. Kyle Nelson, Lehi, UT (US); Tracy Burnham, Pleasant Grove, UT (US)

(72) Inventors: R. Kyle Nelson, Lehi, UT (US); Tracy Burnham, Pleasant Grove, UT (US)

( * ) Notice: Subject to any disclaimer, the term of this patent is extended or adjusted under 35 U.S.C. 154(b) by 129 days.

(21) Appl. No.: 14/227,540

(22) Filed: Mar. 27, 2014

(65) Prior Publication Data

US 2014/0342880 A1 Nov. 20, 2014

Related U.S. Application Data

(60) Provisional application No. 61/824,971, filed on May 17, 2013.

(51) Int. Cl.
*A63B 5/11* (2006.01)
*A63B 21/02* (2006.01)

(52) U.S. Cl.
CPC ..... *A63B 5/11* (2013.01); *A63B 21/023* (2013.01); *A63B 2209/00* (2013.01)

(58) Field of Classification Search
CPC ..... A63B 5/11
See application file for complete search history.

(56) References Cited

U.S. PATENT DOCUMENTS

| | | | | |
|---|---|---|---|---|
| 3,050,746 | A * | 8/1962 | Mikesell | A63B 5/11 182/139 |
| 5,637,057 | A | 6/1997 | Collura | |
| 6,017,292 | A * | 1/2000 | Gift | A63B 5/11 482/27 |
| 6,139,474 | A | 10/2000 | Gift et al. | |
| 6,193,632 | B1 * | 2/2001 | Steger | A63B 5/11 482/27 |
| 6,402,662 | B1 * | 6/2002 | Rieber | A63B 5/11 482/27 |
| 7,291,196 | B1 | 11/2007 | Lerner | |
| 7,494,445 | B1 * | 2/2009 | Chen | A63B 5/11 482/27 |
| 7,691,032 | B2 | 4/2010 | Burnham et al. | |
| 2005/0054485 | A1 | 3/2005 | McDermott et al. | |
| 2011/0281083 | A1 * | 11/2011 | Kim | A41D 13/0153 428/190 |

OTHER PUBLICATIONS

PCT International Search Report for PCT International Patent Application No. PCT/US2014/032021, mailed Aug. 1, 2014.

* cited by examiner

*Primary Examiner* — Oren Ginsberg
(74) *Attorney, Agent, or Firm* — Holland & Hart LLP

(57) ABSTRACT

An in-ground trampoline including a frame, trampoline mat, a plurality of springs and a protective pad. The protective pad incorporates a permeable material to allow for the passage of air through the protective pad. The in-ground trampoline system may also include a retaining wall which may comprise self-locking panels. In some embodiments, the self-locking panels may be attached to the frame of the in-ground trampoline.

19 Claims, 7 Drawing Sheets

IN-GROUND TRAMPOLINE PAD SYSTEM

RELATED APPLICATIONS

This application claims the benefit of U.S. Provisional Application No. 61/824,971, filed on May 17, 2013, and entitled "In-Ground Trampoline Mat System," which application is incorporated herein in its entirety by the above reference.

TECHNICAL FIELD

The present disclosure relates generally to trampolines, and more specifically to in-ground trampolines and protective pads associated therewith. The present in-ground trampoline system is particularly advantageous for provision of a more safety compliant configuration in view of conventional sub-surface trampoline systems.

BACKGROUND

Trampolines have long provided popular recreational and sports related activities, and are increasingly utilized for establishing physical fitness via cardiovascular, strength and resistance training, and for improving physical control, coordination, and mental acuity. In particular, trampolines are a popular recreational use amongst children and young adults. Historically, athletes engaged in competitive gymnastics also utilize trampolines. Other uses include dive training to simulate and practice aerial maneuvers.

Although popular in use, above-ground trampolines are often characterized as unsafe recreational and/or sports training implements, due in large part to the significant and ever-increasing number of trampoline-related injuries. Specifically, the most common trampoline-related injuries include sprains, cuts, contusions, and various forms of bodily fractures, including life-threatening fractures to the skull and spine. Many such injuries occur when the trampoline user falls from the above-ground trampoline and sustains injury upon impact with the surface below and/or with other fixed objects in the area surrounding the trampoline. The extent of the injuries is often exacerbated by the added height of the above-ground trampoline. When combined with the jump height, the added height of the trampoline increases the energy of impact, which, in turn, increases the extent and severity of the injuries.

In an effort to reduce the number of trampoline fall-related injuries, medical societies and associations recommend that the trampoline jumping surface or mat be positioned at ground level, thereby significantly reducing the drop or fall height, and thus, the likelihood and/or severity of injuries resulting from the same. Notwithstanding such recommendations, barriers to implementing trampoline systems with a ground-level jumping surface, include cost, non-standard design and construction requirements, difficulties in construction, and/or difficulties in disassembling and relocating the in-ground trampoline unit.

In response to the need for an in-ground trampoline system (i.e., placing the trampoline jumping mat or surface at ground level), a number of in-ground trampoline systems have been developed that can be installed, for example, by a homeowner or a landscaper. One such example is exhibited by U.S. Pat. No. 7,691,032, which patent is incorporated herein by reference in its entirety.

However, in-ground trampoline placement creates additional issues not present when the trampoline is located above-ground. Often in-ground trampolines do not have adequate ventilation to release air trapped below the trampoline mat when a jumper compresses the mat. Essentially, the jumper compresses the mat, thereby reducing the volume below the trampoline system. Since the base of the trampoline is now sub-surface, sidewalls prevent the escape of the now compressed air. Consequently, the compressed air is forced past the protective pad. Because traditional protective pads are made of a pad wrapped in a nylon or other polymeric coating, the compressed air cannot escape through the protective pad, resulting in the air forcing the protective pad up and down in response to the compression and expansion of the sub-mat volume. Along with the noise and distraction associated with the rise and fall of the protective pad, the restricted air flow can reduce the force returned by the trampoline mat, thereby reducing the potential height of the jumper. These issues often cause users to remove the protective pad and operate the trampoline with the support structures and springs exposed to the user. This condition greatly reduces the safety of the system.

Therefore, it is readily apparent that there is a need for an in-ground trampoline system that provides maximum safety, while eliminating the above-mentioned disadvantages typically associated with an in-ground trampoline.

SUMMARY

An exemplary embodiment of the present system and method overcomes the above-mentioned disadvantages and meets the recognized need for such a device by providing an in-ground trampoline including a frame, trampoline mat, a plurality of springs and a protective pad. The protective pad may incorporate a permeable material or configuration to allow for the passage of air through the protective pad. According to one exemplary embodiment, one or more orifices may be formed in the protective pad. In some embodiments, the in-ground trampoline system may also include a retaining wall.

According to another exemplary embodiment, the present system provides a trampoline protective pad including an upper covering, a lower covering, and a foam member. In some embodiments, the foam member may include a plurality of orifices.

According to another exemplary embodiment, the present system provides an in-ground trampoline system with a retaining wall and a trampoline. The trampoline may include a trampoline mat, a protective pad, and plurality of springs. The protective pad may comprise an upper covering, a lower covering, and a foam member. The foam member may include a plurality of orifices defined therein.

In one or more other aspects that may be combined with any of the aspects herein, may further include an in-ground trampoline system having a trampoline including a frame, a trampoline mat, a protective pad, and a plurality of coiled springs.

In one or more other aspects that may be combined with any of the aspects herein, may further include the protective pad having at least one orifice defined there through.

In one or more other aspects that may be combined with any of the aspects herein, wherein the protective pad further comprises a plurality of orifices defined therein.

In one or more other aspects that may be combined with any of the aspects herein, may further include a mesh covering formed on top of the protective pad, wherein the mesh covering includes a plurality of orifices.

In one or more other aspects that may be combined with any of the aspects herein, may further include the orifices comprising one of a circular cross-section, a square cross-section, an elliptical cross-section, a triangular cross-section, a polygon cross-section, or a random cross-section.

In one or more other aspects that may be combined with any of the aspects herein, may further include the protective pad being between 0.001 inches and three feet thick.

In one or more other aspects that may be combined with any of the aspects herein, may further include the protective pad being approximately one inch thick.

In one or more other aspects that may be combined with any of the aspects herein, may further include a retaining wall, wherein the retaining wall includes a plurality of interlocking panels.

In one or more other aspects that may be combined with any of the aspects herein, may further include the frame being coupled to the retaining wall.

According to another exemplary embodiment, a trampoline protective pad includes an upper covering, a lower covering, and a foam member disposed between the upper and lowering coverings, wherein the foam member includes a plurality of orifices defined therein.

In one or more other aspects that may be combined with any of the aspects herein, may further include the upper covering including at least a portion formed of a permeable material.

In one or more other aspects that may be combined with any of the aspects herein, may further include wherein the permeable material is made of a mesh material.

In one or more other aspects that may be combined with any of the aspects herein, may further include the mesh material having a second plurality of orifices.

In one or more other aspects that may be combined with any of the aspects herein, may further include wherein the orifices comprise one of a circular cross-section, a square cross-section, an elliptical cross-section, a triangular cross-section, a polygon cross-section, or a random cross-section.

In one or more other aspects that may be combined with any of the aspects herein, may further include wherein the foam member is between 0.001 inches thick and three feet thick.

In one or more other aspects that may be combined with any of the aspects herein, may further include wherein the foam member is one inch thick.

In one or more other aspects that may be combined with any of the aspects herein, may further include wherein the upper and lower coverings are substantially covered by the mesh material.

In one or more other aspects that may be combined with any of the aspects herein, may further include wherein the upper covering includes a plurality of segregated portions made of a mesh material.

According to yet another exemplary embodiment, an in-ground trampoline system includes a retaining wall, a trampoline including a frame, a trampoline mat, a protective pad, and a plurality of coiled springs. Wherein the protective pad includes an upper covering, a lower covering, and a foam member, wherein the foam member includes a first plurality of orifices defined therein.

In one or more other aspects that may be combined with any of the aspects herein, may further include wherein the foam member is one inch thick.

In one or more other aspects that may be combined with any of the aspects herein, may further include wherein the upper covering includes at least a portion formed of a mesh material, wherein the mesh material includes a second plurality of orifices.

BRIEF DESCRIPTION OF THE DRAWINGS

The accompanying drawings illustrate various exemplary embodiments of the present system and method and are a part of the specification. Together with the following description, the drawings demonstrate and explain the principles of the present system and method. The illustrated embodiments are examples of the present system and method and do not limit the scope thereof.

Throughout the drawings, identical reference numbers designate similar but not necessarily identical elements.

DETAILED DESCRIPTION

The present specification describes a system and a method for a protective pad including a plurality of air passages or orifices configured to allow for the passage of air through the protective pad, without significantly reducing the protection and safety level of the pad. Further details of the present exemplary systems and methods will be provided below.

The present exemplary ventilated protective pad may help reduce airflow restriction of trampolines installed at ground-level. Exemplary embodiments may allow trapped air to flow freely through the protective pad, which may increase the bounce quality of the in-ground trampoline, and may reduce "pad slap," where the air from jumping normally forces the standard non-ventilated protective pad up, causing it to slap back down on the springs.

Figure 1:
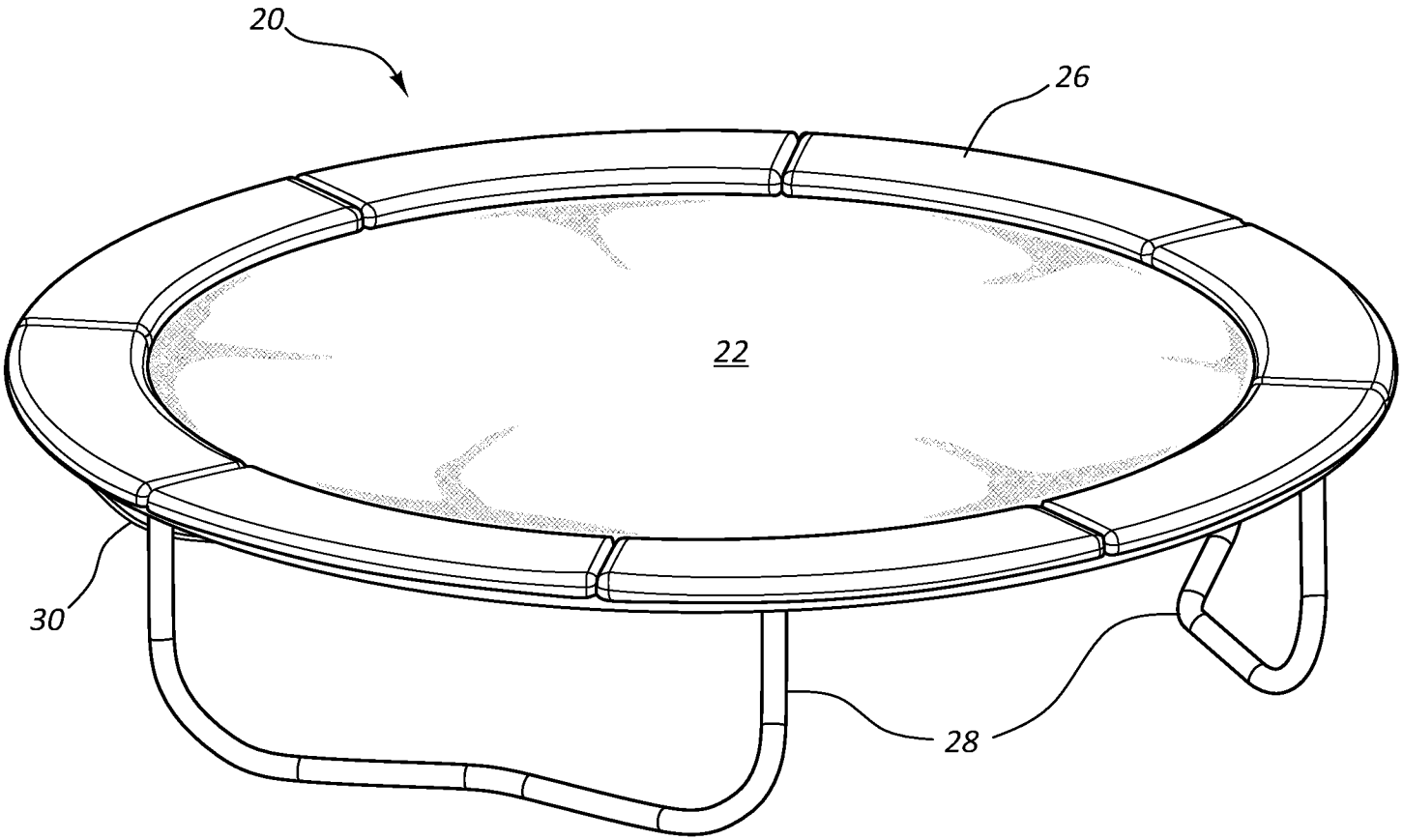
FIG. 1 is an assembled perspective view of a trampoline, according to one exemplary embodiment.

FIG. 1 illustrates a standard trampoline 20, according to one exemplary embodiment. As shown, the trampoline 20 includes a structural frame 30 having a top ring (not shown), a trampoline mat 22 upon which a user bounces, and a plurality of resistive elements (not shown), for example, springs, coupling the mat 22 to the structural frame 30. A protective pad 26 is illustrated as covering the springs and the structural frame 30, typically to protect the user.

Figure 2:
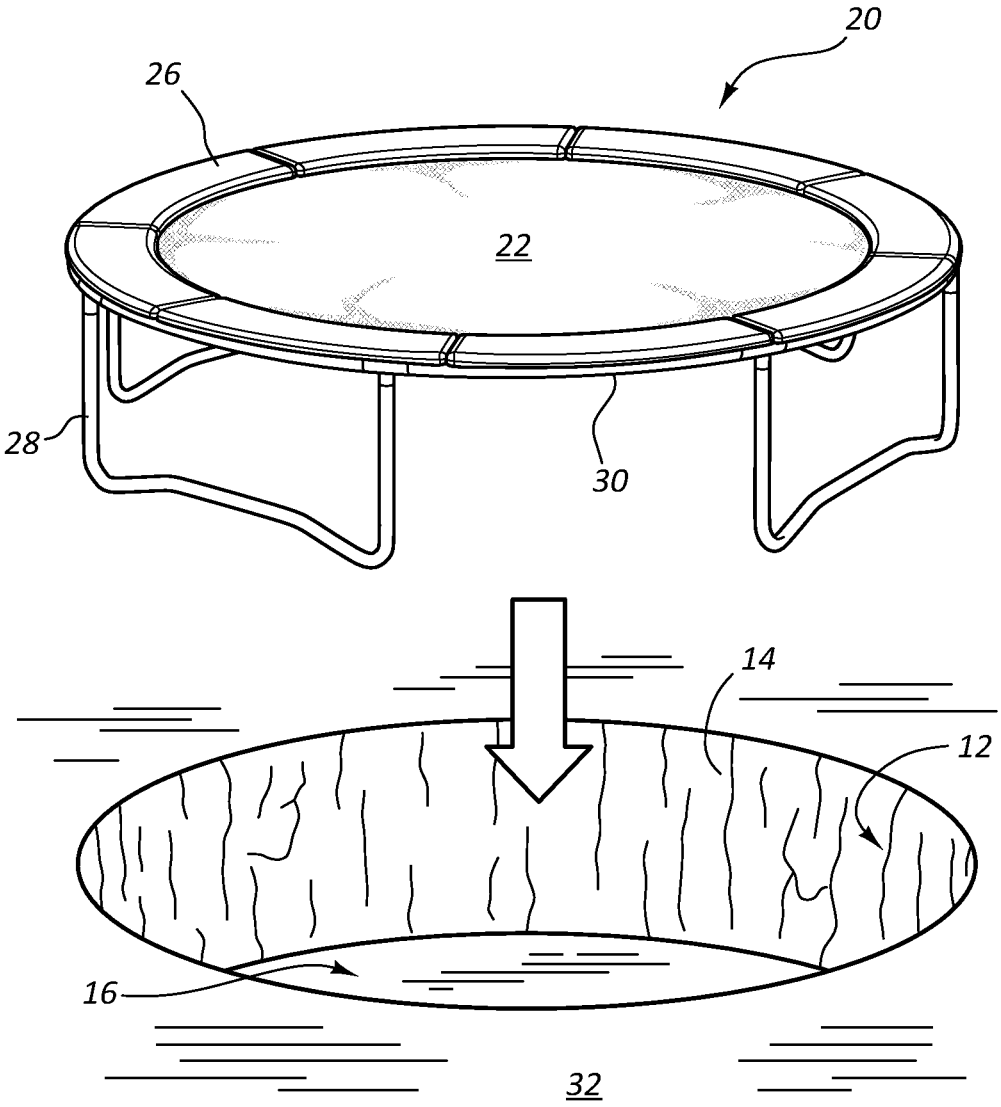
FIG. 2 is a perspective view of a trampoline being inserted into a subsurface depression, according to one exemplary embodiment.

Now referring to FIG. 2, an exploded perspective view of an exemplary in-ground trampoline system is shown including a retaining wall 12 lining the wall of a pit 16, configured to receive the trampoline 20. The trampoline 20 comprises a trampoline mat 22, a protective pad 26, a frame 30, and a plurality of legs 28. The mat 22 may be coupled to the frame 30 by a plurality of resistive elements (not shown) such as, for example, springs, ties, cords, or combinations thereof.

In constructing an in-ground trampoline assembly, the user first creates a pit 16. The pit 16 is a depression below the surrounding surface 32 of sufficient depth to receive the trampoline 20. For example, the depth of the pit 16 may be substantially equivalent to a height of the trampoline 20. The retaining wall 12 may be placed within the pit 16 to maintain the pit geometry. The pit geometry may be substantially similar to the geometry of the trampoline 20. The retaining wall 12 may be created from a single panel or a plurality of panels 14. The plurality of panels 14 may be coupled together, for example, the panels 14 may be coupled via screws, glue, resistive elements, brackets, snap fit, or any such combination. In some embodiments, the plurality of panels 14 may be interlocked with each other. The panels 14 may form a barrier capable of stabilizing the wall of the pit 16. The trampoline 20 may be placed within the pit 16 and may be supported by the trampoline legs 28 which may rest on the bottom of the pit 16. The retaining wall 12 may be connected to the trampoline 20 after the trampoline 20 is placed in the pit 16. In other embodiments, the retaining wall 12 may be coupled to the structural frame 30 and the retaining wall 12 and the trampoline 20 may be placed in the pit 16 simultaneously. For example, the structural frame 30 may be affixed to the retaining wall 12 via a series of clamps, screws, bolts and nuts, compression members, glue, brackets, or any other means sufficient to couple the retaining wall 12 and the structural frame 30. In some embodiments, there is no structural retaining wall 12 at all.

In exemplary embodiments, when the trampoline 20 is placed within the pit 16, the trampoline mat 22 may be preferably at substantially the same height as the surrounding surface 32, thus reducing the potential danger of injury to a trampoline user who may fall off the trampoline mat 22 and may impact the surface 32.

In other exemplary embodiments, the insertion of a trampoline 20 into the pit 16 may typically result in a tight fit. For example, the distance between the edge of the trampoline 20 and the wall of the pit 16 may be substantially negligible. In some embodiments, the tight fit may prevent potentially dangerous gaps between the trampoline 20 and the surrounding surface 32. Consequently, inadequate and/or nonexistent ventilation may prevent the escape of air when the volume under the mat 22 is compressed by a user jumping thereon. As such, the potential bounce may be decreased and pad slap may occur.

Figure 3:
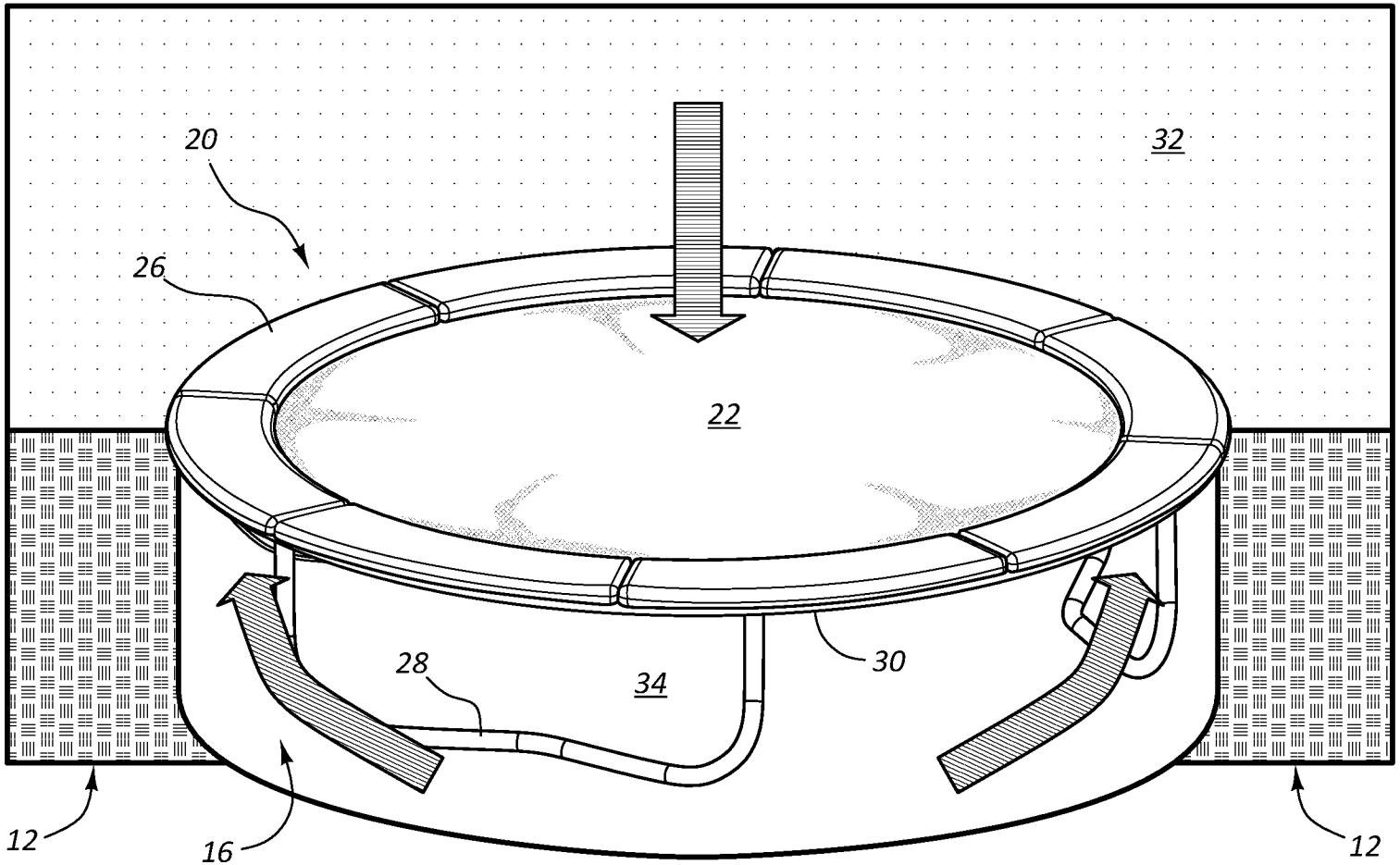
FIG. 3 is a cross-sectional perspective view of a sub-surface trampoline illustrating the direction of air escape, according to one exemplary embodiment.

Specifically, as illustrated in FIG. 3, when a user bounces on the mat 22 (illustrated by the downward arrow), the mat 22 may depress into a space 34 below the mat 22, thereby reducing the total effective volume below the mat 22. This reduction in effective volume may increase the air pressure below the mat 22 which may cause the air to seek an escape. The air may be forced past the springs as illustrated by the two lower arrows in FIG. 3.

Figure 4:
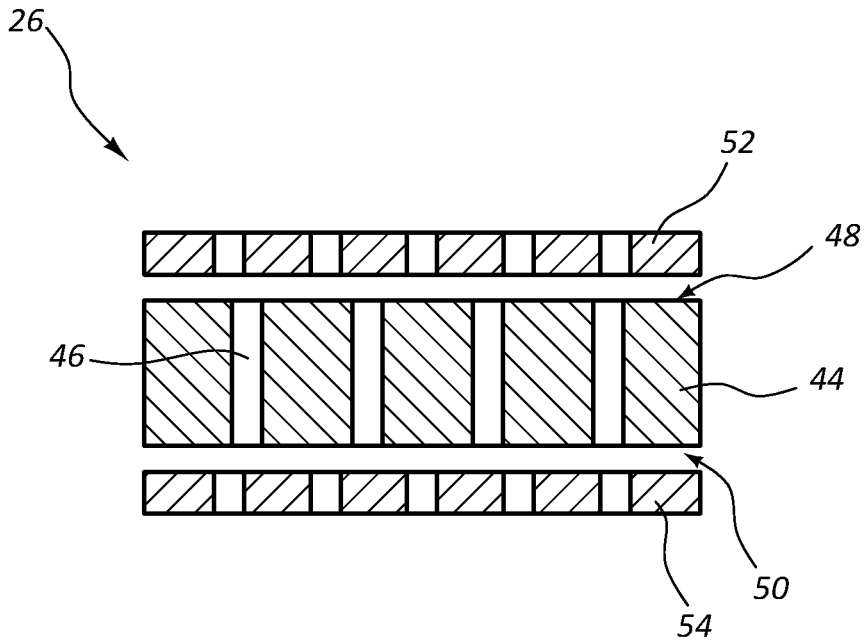
FIG. 4 is a cross-sectional view of an exemplary pad configuration, according to one exemplary embodiment.

As shown in FIG. 4, an exemplary protective pad system 26 may allow for the passage of air from beneath the mat 22 without a reduction in user bounce or user safety. According to one exemplary embodiment, the protective pad 26 may include a foam member 44. The foam member 44 may be water resistant and/or mold resistant and may consist of a permeable material. For example, the foam member 44 may be sufficiently permeable to allow for the flow of air there through. The foam member 44 may be between approximately 0.001 inches and approximately three feet thick, and have a width sufficient to at least partially cover the frame 30 and/or springs. According to one exemplary embodiment, the foam member 44 may be between approximately 0.25 inches and 3 inches thick; and ideally may be approximately one inch thick.

The foam member 44 may be formed of any number of substantially cushioning materials. According to one exemplary embodiment, the foam member 44 may be formed of either a high density or low density foam including, for example, a polyurethane foam, a high density polyurethane foam, an Evlon or Lux foam, a high resilience foam, a latex rubber foam, a supreme foam, a rebond foam, a memory foam, a closed cell foam, a high density urethane foam, XPS foam, polystyrene foams, phenolic foams, and the like. As noted above, the foam member 44 may be, according to one exemplary embodiment, a water resistant and/or mold resistant one inch foam pad. In some embodiments, the thickness of the foam pad may vary between approximately 0.001 inches and approximately three feet.

Figure 5A:
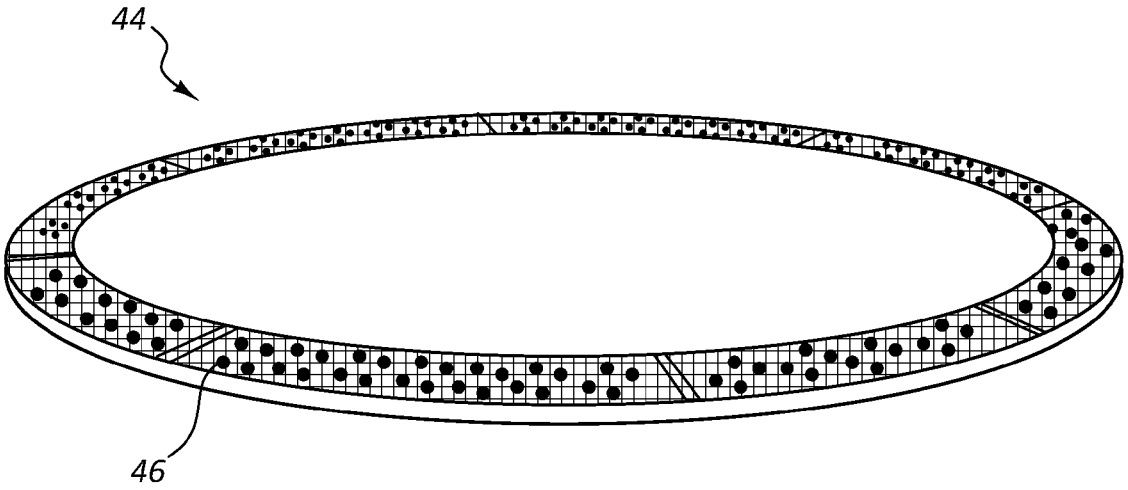
FIGS. 5*a*-5*d* are perspective views of exemplary pad configurations, according to various exemplary embodiments.
Figure 5B:
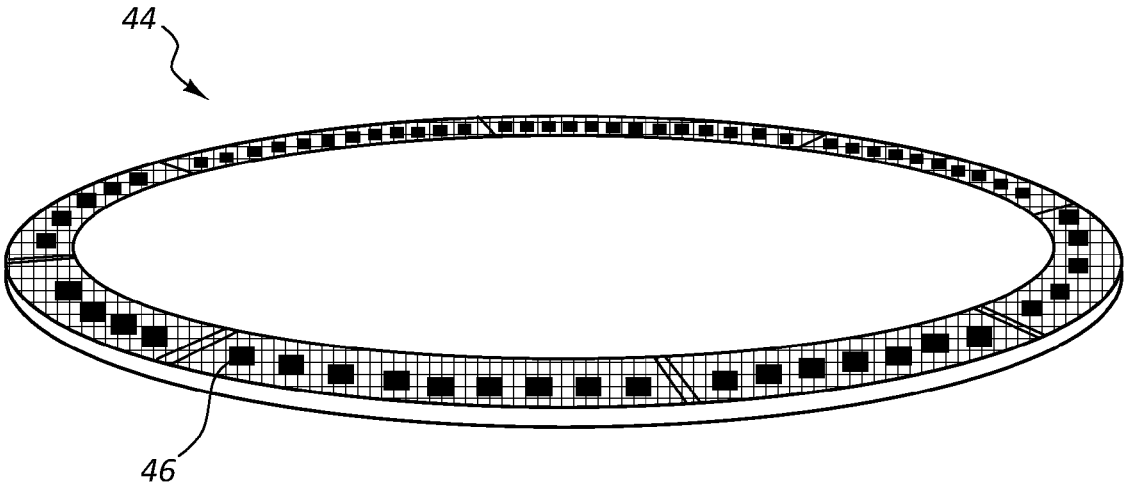
Figure 5C:
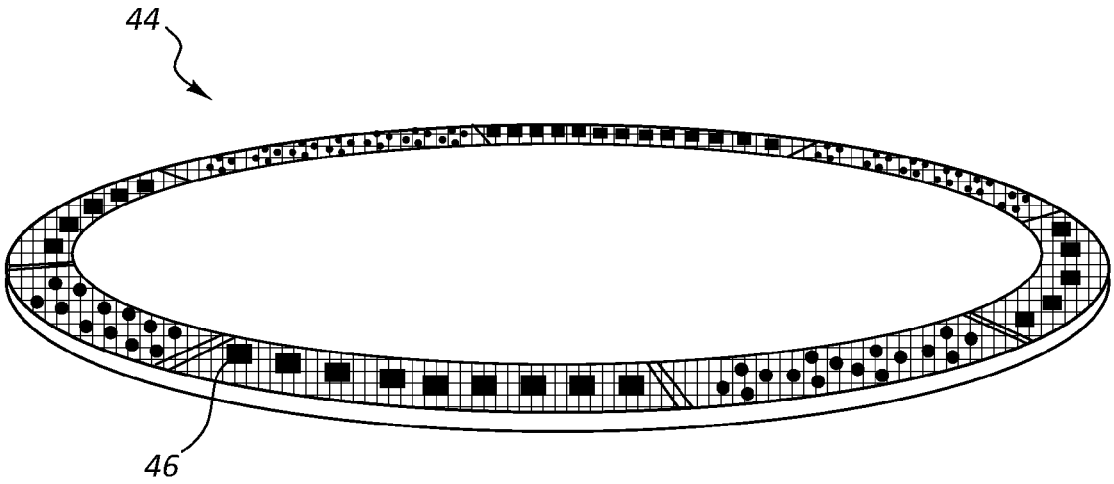
Figure 5D:
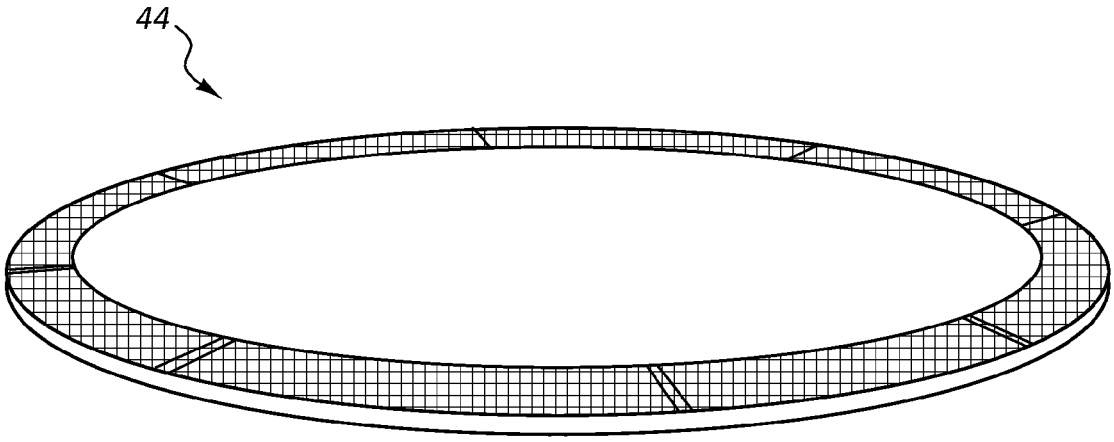

Furthermore, as shown in FIG. 4, in some embodiments, the foam member 44 may include a plurality of orifices 46 formed therein to allow airflow between a top 48 and a bottom 50 of the foam member 44. The orifices 46 may allow for the escape of air compressed by the trampoline mat 22 during use. As illustrated in FIGS. 5*a*-5*d*, the orifices 46 formed in the foam member 44 may assume any number of cross-sectional shapes including, but in no way limited to, triangles, circles, ellipses, squares, rectangles, polygons, and the like. Also, for example, as shown in FIG. 5*c*, any combination of orifice shapes and sizes may be simultaneously used therein. Also, for example, as shown in FIG. 5*d*, the orifices 46 may be sufficiently small that they are not easily viewed, but still effectively provide a conduit for the passage of air between the foam member 44. According to one exemplary embodiment, the foam including the plurality of orifices 46 may be formed in the foam member 44 using any number of manufacturing methods including, but in no way limited to, forming the orifices in mold during the expansion of the foam, using the Talalay process, using the MDI process, continuous extrusion, lamination, post foam manufacturing; such as cutting, melting, stamping, and the like.

Figure 6:
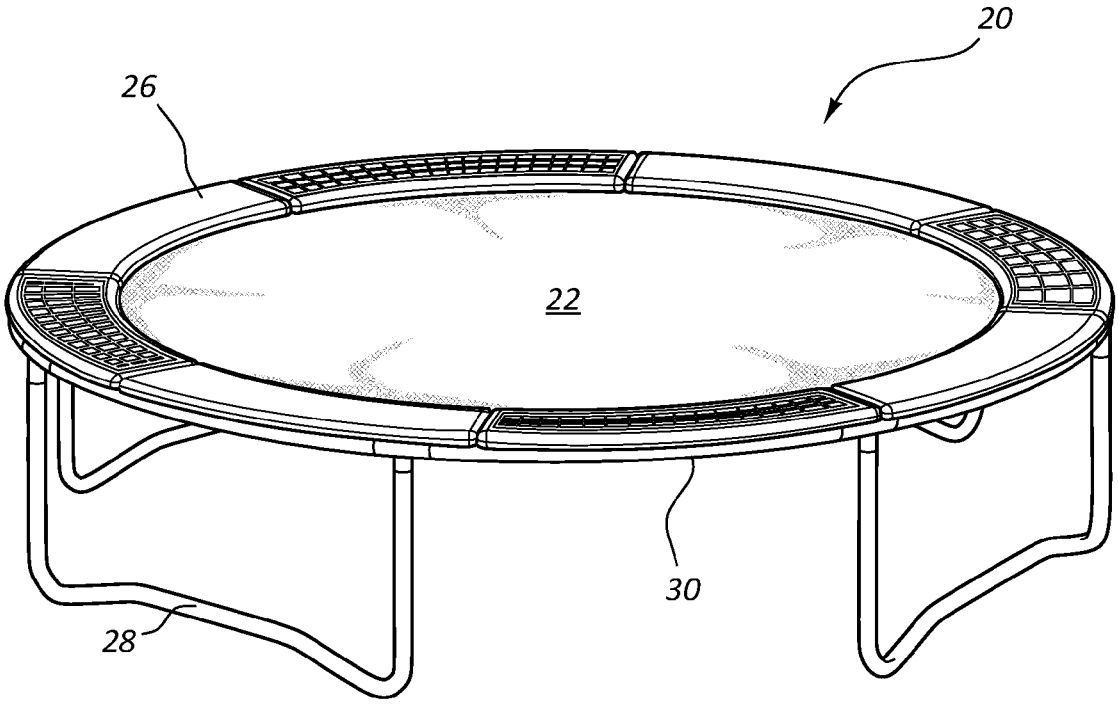
FIG. 6 is a perspective view of exemplary pad configurations, according to one exemplary embodiment.
Figure 7:
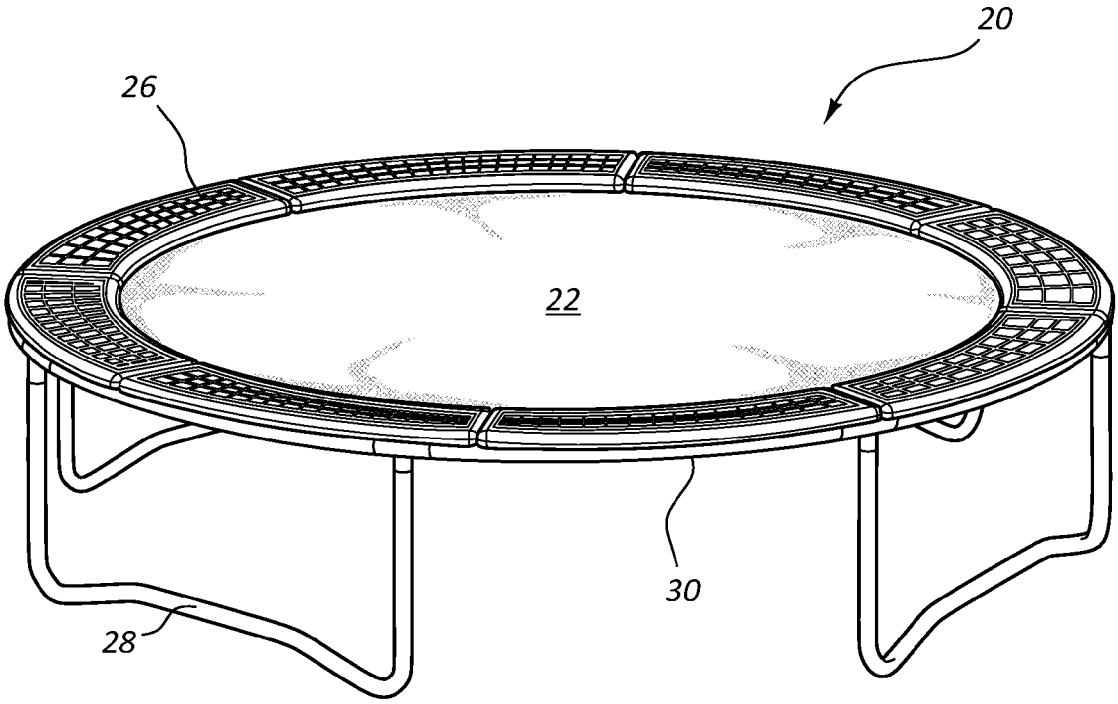
FIG. 7 is a perspective view of exemplary pad configurations, according to one exemplary embodiment.

Referring back to FIG. 4, in some embodiments, the protective pad 26 may include an upper covering 52 and a lower covering 54. The foam member 44 may be disposed between the upper 52 and lower 54 coverings. According to one exemplary embodiment, at least a portion of both the upper 52 and lower 54 coverings may be formed of a sufficiently permeable material that may allow air to pass through the pad 26 and coverings 52,54 during use of the trampoline 20. While the material may be any permeable material, according to one exemplary embodiment, the upper 52 and lower 54 coverings of the protective pad 26 may be substantially formed of a nylon mesh. As illustrated in FIG. 6, the entire upper covering 52 of the protective pad 26 may be covered by a substantially mesh material. Alternatively, as shown in FIG. 7, segregated portions of the upper covering 52 of the protective pad 26 may be covered by the mesh material sufficient to allow for the passage of air. Subsequently, the entire lower covering 54 may be covered by a substantially mesh material and/or segregated portions of the lower covering 54 may be covered by the mesh material.

In addition to providing increased air flow, the present exemplary system may provide a surface which does not reach the same extreme temperatures as traditional vinyl pads when exposed to direct sunlight. By maintaining a substantially ambient temperature, the present exemplary protective pad 26 may be more user friendly than standard protective pads.

The preceding description has been presented only to illustrate and describe the present method and system. It is not intended to be exhaustive or to limit the present system and method to any precise form disclosed. Many modifications and variations are possible in light of the above teaching.

The foregoing embodiments were chosen and described in order to illustrate principles of the system and method as well as some practical applications. The preceding description enables others skilled in the art to utilize the method and system in various embodiments and with various modifications as are suited to the particular use contemplated. It is intended that the scope of the present exemplary system and method be defined by the following claims.

What is claimed is:

1. An in-ground trampoline system, comprising:

a retaining wall; and a trampoline including a frame, a trampoline mat, a protective pad having a top surface and a bottom surface, and a plurality of coiled springs;

wherein the protective pad includes a plurality of air passage orifices defined there through, the air passage orifices each extending from the bottom surface to the top surface.

2. The in-ground trampoline system of claim 1, further comprising a mesh covering formed on top of the protective pad, wherein the mesh covering includes a plurality of orifices.

3. The in-ground trampoline system of claim 2, wherein the plurality of air passage orifices comprise one of a circular cross-section, a square cross-section, an elliptical cross-section, a triangular cross-section, a polygon cross-section, or a random cross-section.

4. The in-ground trampoline system of claim 1, wherein protective pad is between 0.001 inches and three feet thick.

5. The in-ground trampoline system of claim 4, wherein the protective pad is one inch thick.

6. The in-ground trampoline system of claim 1, wherein the retaining wall includes a plurality of interlocking panels.

7. The in-ground trampoline system of claim 1, wherein the frame is coupled to the retaining wall.

8. A trampoline protective pad, comprising:

an upper covering;

a lower covering; and a foam member disposed between the upper and lowering coverings;

wherein the foam member includes a top surface, a bottom surface, and a plurality of orifices defined by the foam member;

wherein each of the plurality of orifices extends from the bottom surface of the foam member to the top surface of the foam member, wherein the trampoline protective pad is connected to a trampoline.

9. The trampoline protective pad of claim 8, wherein the upper covering includes at least a portion formed of a permeable material.

10. The trampoline protective pad of claim 9, wherein the permeable material is made of a mesh material.

11. The trampoline protective pad of claim 10, wherein the mesh material includes a second plurality of orifices.

12. The trampoline protective pad of claim 8, wherein the orifices comprise one of a circular cross-section, a square cross-section, an elliptical cross-section, a triangular cross-section, a polygon cross-section, or a random cross-section.

13. The trampoline protective pad of claim 8, wherein the foam member is between 0.001 inches thick and three feet thick.

14. The trampoline protective pad of claim 13, wherein the foam member is one inch thick.

15. The trampoline protective pad of claim 8, wherein the upper and lower coverings are substantially covered by the mesh material.

16. The trampoline protective pad of claim 8, wherein the upper covering includes a plurality of segregated portions made of a mesh material.

17. An in-ground trampoline system, comprising:

a retaining wall;

a trampoline including a frame, a trampoline mat, a protective pad, and a plurality of coiled springs;

wherein the protective pad includes an upper covering, a lower covering, and a foam member;

wherein the foam member includes a top surface, a bottom surface, and a first plurality of orifices defined by the foam member;

wherein each of the first plurality of orifices extends from the bottom surface of the foam member to the top surface of the foam member.

18. The in-ground trampoline system of claim 17, wherein the foam member is one inch thick.

19. The in-ground trampoline system of claim 17, wherein the upper covering includes at least a portion formed of a mesh material, wherein the mesh material includes a second plurality of orifices.

* * * * *